US006923454B2

(12) United States Patent
Drako

(10) Patent No.: US 6,923,454 B2
(45) Date of Patent: Aug. 2, 2005

(54) SNOWBOARD BINDING ROTATIONAL MECHANISM

(76) Inventor: Dean M. Drako, 120 W. Edith Ave., Los Altos, CA (US) 94022

( * ) Notice: Subject to any disclaimer, the term of this patent is extended or adjusted under 35 U.S.C. 154(b) by 104 days.

(21) Appl. No.: 10/331,626

(22) Filed: Dec. 30, 2002

(65) Prior Publication Data

US 2004/0124597 A1 Jul. 1, 2004

(51) Int. Cl.[7] ..... B62B 15/00

(52) U.S. Cl. ..... 280/14.24; 280/607; 280/618; 280/629

(58) Field of Search ..... 280/607, 617, 280/618, 620, 626, 629, 14.21, 14.22, 14.24

(56) References Cited

U.S. PATENT DOCUMENTS

| | | | | | |
|---|---|---|---|---|---|
| 4,871,337 | A | | 10/1989 | Harris | 441/74 |
| 4,964,649 | A | | 10/1990 | Chamberlin | 280/618 |
| 5,044,654 | A | | 9/1991 | Meyer | 280/613 |
| 5,190,311 | A | | 3/1993 | Carpenter et al. | 280/618 |
| 5,236,216 | A | | 8/1993 | Ratzek | 280/607 |
| 5,261,689 | A | | 11/1993 | Carpenter et al. | 280/618 |
| 5,354,088 | A | | 10/1994 | Vetter et al. | 280/618 |
| 5,499,837 | A | | 3/1996 | Hale et al. | 280/607 |
| 5,667,237 | A | | 9/1997 | Lauer | 280/607 |
| 5,732,959 | A | | 3/1998 | Soejima | 280/14.2 |
| 5,762,358 | A | * | 6/1998 | Hale | 280/607 |
| 5,791,678 | A | * | 8/1998 | Perlman | 280/618 |
| 5,876,045 | A | * | 3/1999 | Acuna, Jr. | 280/14.24 |
| 5,890,729 | A | * | 4/1999 | Bayer et al. | 280/618 |
| 5,984,346 | A | * | 11/1999 | Keller | 280/634 |
| 6,102,430 | A | * | 8/2000 | Reynolds | 280/618 |
| 6,302,411 | B1 | * | 10/2001 | Huffman et al. | 280/14.24 |
| 6,467,794 | B1 | * | 10/2002 | De France | 280/607 |
| 6,491,310 | B1 | * | 12/2002 | Work | 280/14.24 |

* cited by examiner

*Primary Examiner*—Christopher P. Ellis
*Assistant Examiner*—Brian Swenson
(74) *Attorney, Agent, or Firm*—Law Offices of Terry McHugh

(57) ABSTRACT

A mounting assembly in accordance with the invention provides rotational adjustment of a board binding, such as a binding of a snowboard, wakeboard, or the like, without the use of external tools. A spacer plate which enables the mounting of the binding in a position above the board is combined with a mechanism which can change its thickness on demand, thereby locking or unlocking the binding from a freely rotatable position.

13 Claims, 4 Drawing Sheets

SNOWBOARD BINDING ROTATIONAL MECHANISM

TECHNICAL FIELD

The present invention relates to recreational boards, such as a snowboard or wakeboard, and more particularly boot-binding mounts that can be attached to a recreational board.

BACKGROUND ART

Snowboarding is a sport which can be visually compared to skateboarding and surfing, except it is done on snow. Snowboard skiing is the legal name for snowboarding, which thereby affords snowboarding all the privileges and liabilities of alpine skiing. To snowboard, the rider stands on the board with the left or right foot forward. Both feet are directed toward the same side of the board. The feet are attached to the board via high-back or plate bindings which are non-releasable. Although there is at least one manufacturer of releasable bindings, they are not widely used.

Snowboarding has gained in popularity during the last 10 years. It was pioneered in the late 1970's by a group of individuals with credit going to Jake Burton and Tom Sims. Both individuals head snowboard manufacturers, with Burton being the largest snowboard manufacturer. The cost of snowboard equipment is comparable to ski equipment.

Major competitions utilizing snowboarding equipment are organized, involving major sponsorships, television coverage, and world-class athletes. Competitions include downhill speed runs, slalom races, half-pipe, and freestyle performances. Four major categories of snowboards have been developed and designed, including race, alpine, all-around/free-riding, and half-pipe/freestyle.

Several different types of binding systems are known in the art, as represented by the binding systems shown in U.S. Pat. Nos. 5,354,088; 5,236,216; 5,190,311; 5,044,654; 4,964,649; 4,871,337. Two types of bindings are most commonly used in snowboarding: the high-back and the plate. The high-back binding is characterized by a vertical plastic back piece which is used to apply pressure to the heel-side of the board. This binding has two straps which extend over the foot, with one strap applying pressure to the heel region and the other applying pressure to the toe region. Some high-back bindings also have a third strap (a "shin strap") on the vertical back piece, which gives additional support and aids in toe side turns. The plate, or step-in, binding is used with a hard shell boot much like a ski binding, but it is non-releasable.

Snowboard boot bindings typically include a rotational adjustment which allows the user (i.e., the "rider") to adjust the relative angular position of the boot binding relative to the longitudinal axis of the snowboard, thereby allowing the user to set the bindings in a position of personal comfort. For example, if a user likes to ride with the left leg forward on the snowboard, then the boot binding will typically be adjusted so that the user's foot (toes) points to the user's right relative to the longitudinal axis of the snowboard. Similarly, if a user rides with the right leg forward, the boot binding will usually be adjusted so that the toes point to the user's left. The amount of the rotational adjustment varies greatly as a function of individual preference.

For different events, the desired rotational adjustment may vary significantly. For instance, during speed runs such as Giant Slalom (GS), the snowboarder may prefer to have both feet oriented more straight ahead. For other events such as freestyle, the desired angle may be one in which the feet are oriented more perpendicular to the longitudinal axis. According to the publication "Transworld Snowboarding," the average stances of pro riders from different snowboarding disciplines are as follows (with widths in inches, center being inches back from center, length in cm, and angles in degrees relative to the perpendicular to the longitudinal axis):

| | Stance width | Front angle | Rear angle | Center | Board length | Notes |
|---|---|---|---|---|---|---|
| Half-pipe | 20.7" | 17 | 2 | 0.5" back | 152.5 cm | some boarders use negative rear angles (duck-stance) |
| Freeride | 21.1" | 22 | 7 | 1.7" back | 170 cm | |
| Slalom | 17" | 49.2 | 47.2 | 0.4" back | 156.8 cm | |
| GS | 17" | 49.6 | 47.6 | 0.44" back | 164.9 cm | |
| Super G | 17.16" | 49.4 | 47.4 | 0.45" back | 170.5 cm | |
| SlopeStyle | 21.3" | 12 | 0 | 1" back | 152.9 cm | 0 rear on all riders (also known as freestyle) |

Presently, snowboard bindings cannot be rotated and locked at different angular positions without using hand tools. Bindings are secured to the board by either inserts or a retention plate. Inserts consist of a nut built into the board, with a machine screw being used to secure the binding. With the retention plate system, a sheet metal screw is used after tapping a hole into the board. It is referred to as a retention plate because a metal plate is built into the board where the board will be tapped. In use, the commercially available boot bindings are typically screwed or bolted to the board using a round disk and one of two-hole patterns: a three-hole pattern shown in U.S. Pat. No. 5,261,689 to Carpenter et al., or a four-hole pattern. Each pattern provides four different positions or settings for stance adjustment of each binding.

With either hole pattern method, the user must first remove the boot from the binding and then loosen the series of screws, typically with a screwdriver, so the binding can be rotated and repositioned at the desired angle. The screws must be retightened to lock the binding in place and the user can then reinsert the boot into the binding. Such an operation is time consuming and inconvenient for the snowboarder. It would be impractical to require a snowboarder to repeatedly perform such a field operation in a single day. This is particularly true given the high cost of ski-lift tickets and the overall desire by riders to maximize the number of runs performed during any given day.

Most people who use snowboards recreationally prefer to have the front foot positioned at a large angle (e.g. approximately 45 degrees or more) with respect to the longitudinal axis of the snowboard. After snowboarding down the slope, the user typically releases the rear boot and pushes along with the free foot to move the snowboard. Such action is similar to that provided by a skateboarder to move forward on flat surfaces, and hence is called "skating." If enough speed can be achieved via skating, the snowboarder can "glide" by placing the rear foot on the stomp pad which is attached between the bindings. However, unlike skateboarding where both feet are free, the snowboarder's front foot is fixed at an awkward and inconvenient angle, thereby making it difficult to achieve efficient forward locomotion.

Additionally, the inconvenient angle of the user's foot poses a problem when the snowboarder mounts and dismounts the ski lift. When sitting down and extending the legs forward, the angle of the fixed foot causes the snowboard to interfere with adjacent passengers on the ski lift. This causes the snowboarder to uncomfortably twist a foot and/or leg and/or body sideways to compensate for the angle of the snowboard. This is particularly unacceptable in light of the long ride time on many ski lifts.

In recent years, the popularity of snowboarding and wakeboarding has grown at a tremendous rate. To draw more people into the sport of snowboarding, more convenient and comfortable binding systems are required. The cross-orientation of the bindings allows the rider to assume a side-forward stance, which is the necessary positioning for optimal control of the snowboard when going down the hill. While this side-forward positioning is optimal for control on the downhill run, it presents a number of problems between runs.

One solution to the problems is to provide a mechanism that will allow at least one of the bindings to be rotated from the normal transverse angular position to a toe-forward position relative to the snowboard. Then, a rider can adjust the angle before each non-snowboarding use of the snowboard. In U.S. Pat. No. 5,236,216, for example, there is shown a fastening disk that can be clamped upon a binding support plate that can be turned about a normal axis to the board. In order to change the user's foot position, the user must remove his boot from the binding, allowing him to loosen several bolts to allow the rotational position of the binding plate to be changed, then the bolts must be re-tightened. Similarly, in U.S. Pat. No. 5,261,689 to Carpenter et al., a number of bolts through a hold-down plate for a rotatable binding-support plate must be loosened and then re-tightened in order to change the binding orientation. While the aforementioned binding support systems have their advantages, they all share a major drawback in not allowing angular adjustment of bindings to be made quickly, easily, and conveniently, because they require removal of the boot from the binding in each case, and the use of tools to tighten and loosen the bolts.

U.S. Pat. Nos. 5,499,837, 5,667,237 and 5,732,959 recognize some of these problems to snowboard bindings and provide alternative locking mechanisms. However, binding mounts of these patents do not address the concern of snow and ice build-up inhibiting the proper operation fo the locking mechanism.

What is needed is a mounting assembly that provides a snowboarder, wakeboarder, or other rider the capability of rapidly and easily changing the orientation of at least one binding-attached foot from a transverse position on such a board to a foot-forward position, thereby enabling a natural position of the knee, foot, and leg during standing, walking, sitting, "skateboarding," and other activities.

SUMMARY OF THE INVENTION

A mounting assembly for use with a board, such as a snowboard or wakeboard, includes a binding for attachment to a person's foot, a securing mechanism for securing the binding to the board at a selectable angle which is fixed when the binding is engaged with the securing mechanism, and an adjustment mechanism having a thickness which is variable so as to define a lock condition and a release condition. The adjustment mechanism is positioned so that the binding is disengaged from the securing mechanism when the adjustment mechanism is set at a first thickness that establishes the release condition, but the binding and securing mechanism are engaged when the adjustment mechanism is set at a second thickness that establishes the lock condition.

There are a number of contemplated embodiments for achieving the variable thickness for the adjustment mechanism. The embodiments may be lever based, clutch based, material-expansion based, or based generally on the use of upper and lower plates to provide an arrangement in which thickness is selectable.

In one embodiment, the binding and the securing mechanism are formed of components that are conventional to the art of snowboarding. Thus, the binding may be a boot mount having an opening with a first pattern of teeth, while the securing mechanism is a binding disk that is received within the opening. The binding disk may have a second pattern of teeth that locks with the first pattern when the binding disk is pressed into the opening. The lock condition of the adjustment mechanism causes the second pattern of teeth to enter a press-fit engagement with the first pattern. However, the release condition is one in which the binding and binding disk remain attached to the board, but are disengaged from each other, so that relative rotation between the two patterns of teeth can occur.

In one embodiment, the adjustment mechanism is comprised of first and second members that are configured to provide the selectable thickness. One or both of the first and second members may have ramped regions, with the members being configured such that relative rotation therebetween causes the change in thickness. The first member may include slots that are aligned with projections from the second member, enabling the projections to ride within the slots as one member is rotated relative to the other. In this embodiment, the adjustment mechanism may be clutch based.

An advantage of the invention is that the adjustment mechanism may be used with commercially standard bindings and binding disks. Thus, the adjustment mechanism may merely be a retrofit item. As a result of using the invention, a person is able to easily and quickly change the angle of a boot mount relative to a board without disconnecting any parts from the board. Preferably, the angular adjustments are made without the need for hand tools. Since the angle of the boot mount is easily adjusted, an increase in comfort between downhill runs by a snowboarder is achieved. Moreover, there is a reduction in the risk of harmful stress to the leg joints, ligaments and muscles of the snowboarder.

DETAILED DESCRIPTION

Figure 1:
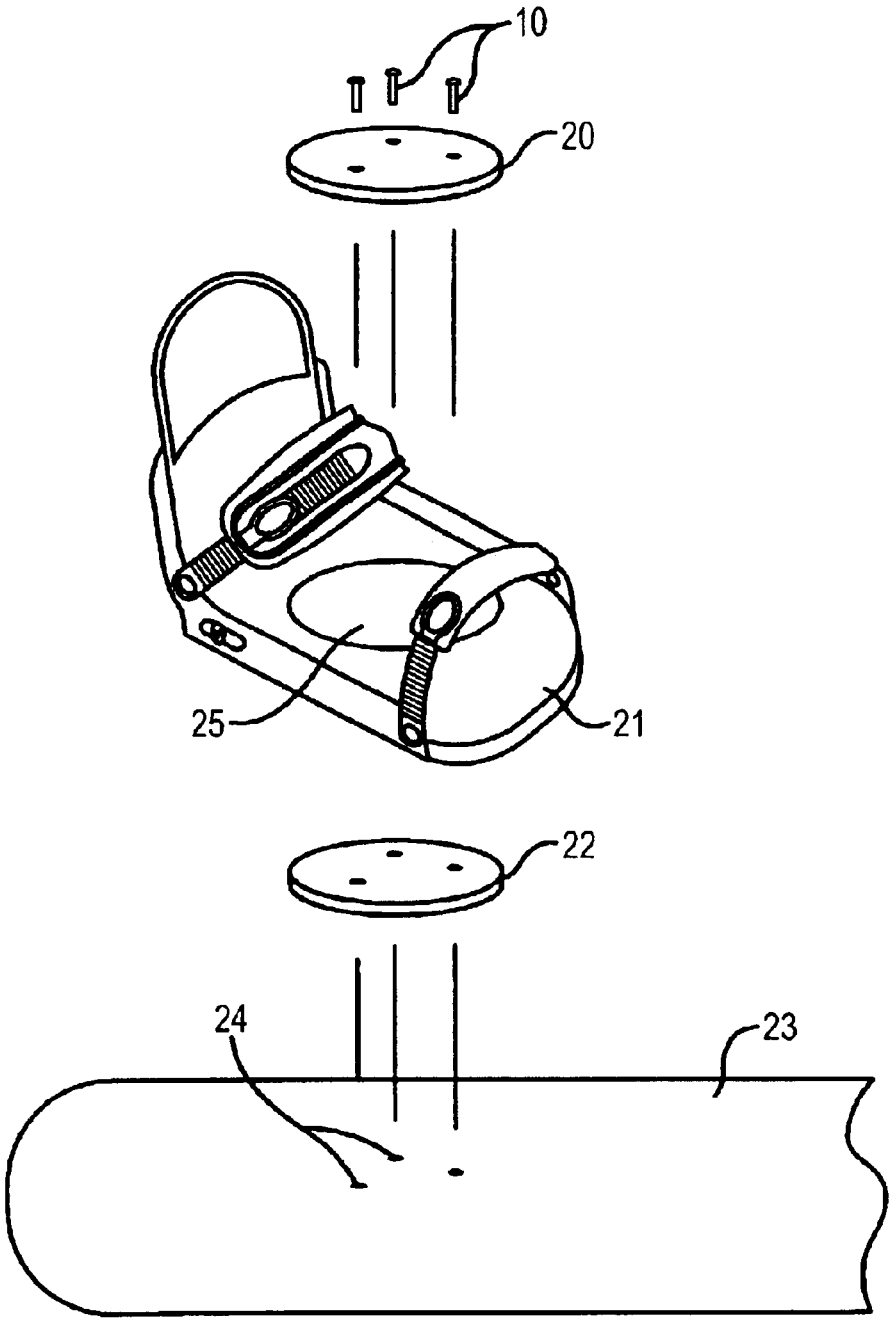
FIG. 1 is a partially exploded perspective view of a binding, binding disk, spacing disk, and snowboard in accordance with the present invention.

With reference to FIG. 1, a binding disk 20 is shown as being adapted to be mounted to a board 23 using screws 10 that are received in internally threaded holes 24 within the board. The binding disk is sometimes referred to as a hold-down plate. The binding disk secures a binding 21 and a spacing disk 22 in fixed positions relative to the board, when the screws 10 are tightly fastened into the internally threaded holes of the board.

The binding disk 20 and the binding 21 may be conventional components that are commercially available. For example, the two components may be identical to those described in U.S. Pat. No. 5,261,689 to Carpenter et al., which is incorporated herein by reference. The binding plate is able to enter into, but not pass through, an opening 25 within the binding. The outer edge of the binding disk is angled inwardly with downward movement, as viewed in FIG. 1. On the other hand, the edge of the opening 25 is angled outwardly with upward movement. As a result, when the binding disk is press-fit into the opening, the correspondingly sloped surfaces are mated. The sloped surfaces have upwardly extending patterns of teeth that prevent relative rotation between the binding and binding disk when the two patterns of teeth are in press-fit engagement. While the sloped surfaces and the use of teeth are described as one possible arrangement, persons skilled in the art will readily recognize that other arrangements are possible without diverging from the invention.

In accordance with the prior art, the spacing disk would not be included, so that when the binding disk 20 is fastened to the board 23, the press-fit engagement of the two patterns of teeth will fix the angle of the binding 21 relative to the longitudinal axis of the board. However, the spacing disk 22 is not a component of prior art mounting assemblies for use with boards in which a foot binding is attached at a selectable angle. The spacing disk has a diameter that is less than that of the opening 25 in the binding. As a consequence, the normally tight mating between the binding disk and the binding is releasable. The binding can be rotated relative to the longitudinal axis of the board merely by ensuring that the spacing disk 22 is sufficiently thick to allow disengagement of the two patterns of teeth.

The difficulty with using the spacing disk 22 by itself is that the binding 21 will be able to rotate at undesired times. Thus, an adjustment mechanism is used with the spacing disk, so that the binding 21 may be selectively locked into a position in which it is in tight press-fit engagement with the binding disk 20. This can be achieved by providing a variable thickness below the surface of the binding, so that the binding is raised and lowered on the basis of the change in thickness. Any number of lever based, clutch based, material-expansion based, or other mechanisms may be used. For example, in a material-expansion based embodiment, a compressible material having a strong expansion memory may be used to bias the binding upwardly, with the bias being overcome by hand pressure applied by a user when the angle of the binding is to be adjusted. In a simplified application, one or more wedges may be slid beneath the binding in order to lock the binding angle. Wedges may easily be fixed to the surface of the board for slidable movement.

Figure 2:
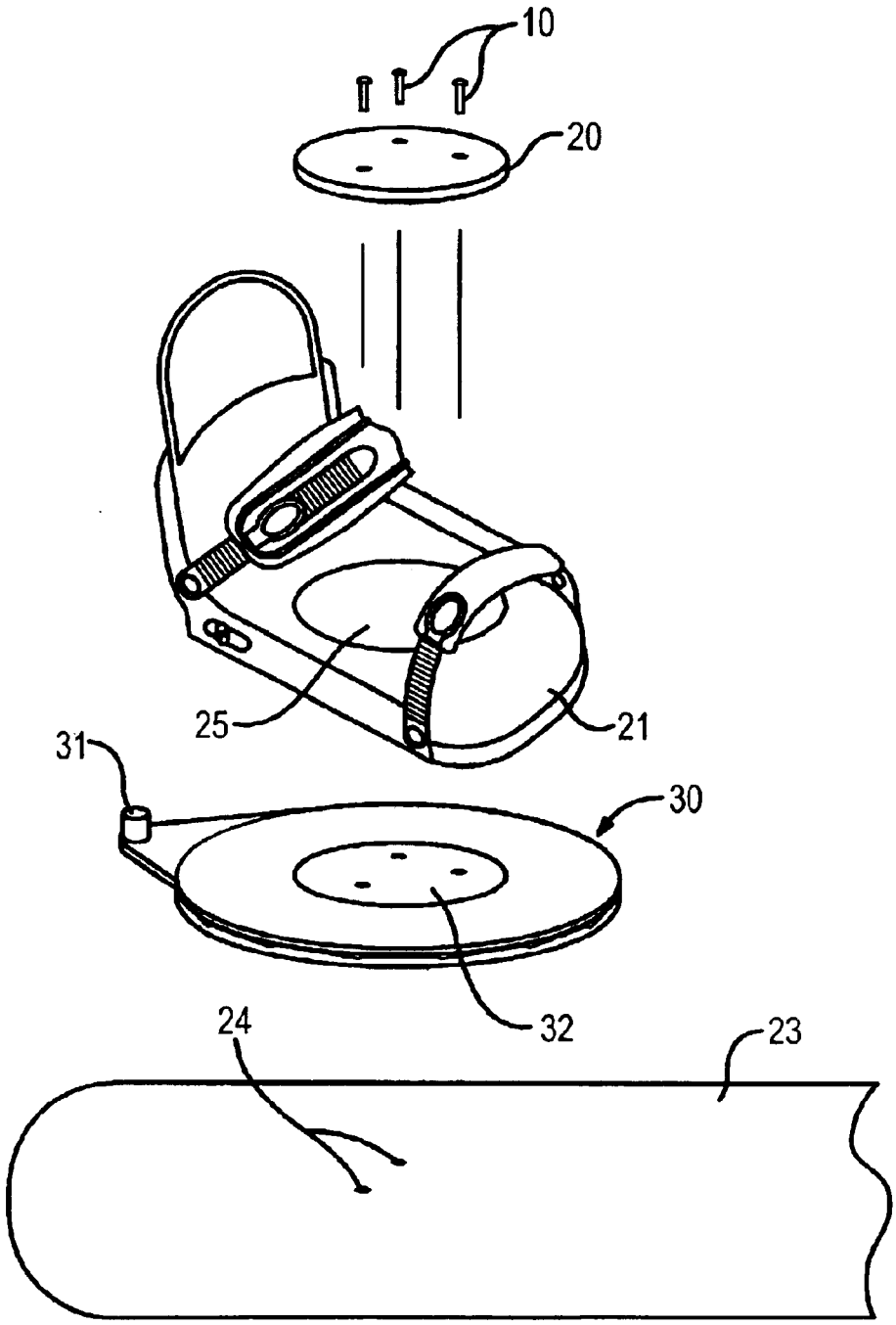
FIG. 2 is a perspective view showing the location of a general clutch device and its change in thickness operation in accordance with one embodiment of the invention.

A more sophisticated arrangement is shown in FIG. 2. In this embodiment, the variations in thickness are achieved using a clutch device 30 (i.e., clutching mechanism). The clutch device can expand and contract in thickness on the basis of movement of a handle 31. When the thickness of the clutch device is similar to that of the spacing disk 32, the binding 21 is forced upwardly into a secure press-fit engagement with the teeth of the binding disk 20. On the other hand, when the thickness of the clutch device is less than that of the spacing disk, the binding is free to move downwardly and rotate relative to the binding disk. The rotation relative to the binding disk varies the angle of the binding relative to the longitudinal axis of the board 23.

Figure 3:
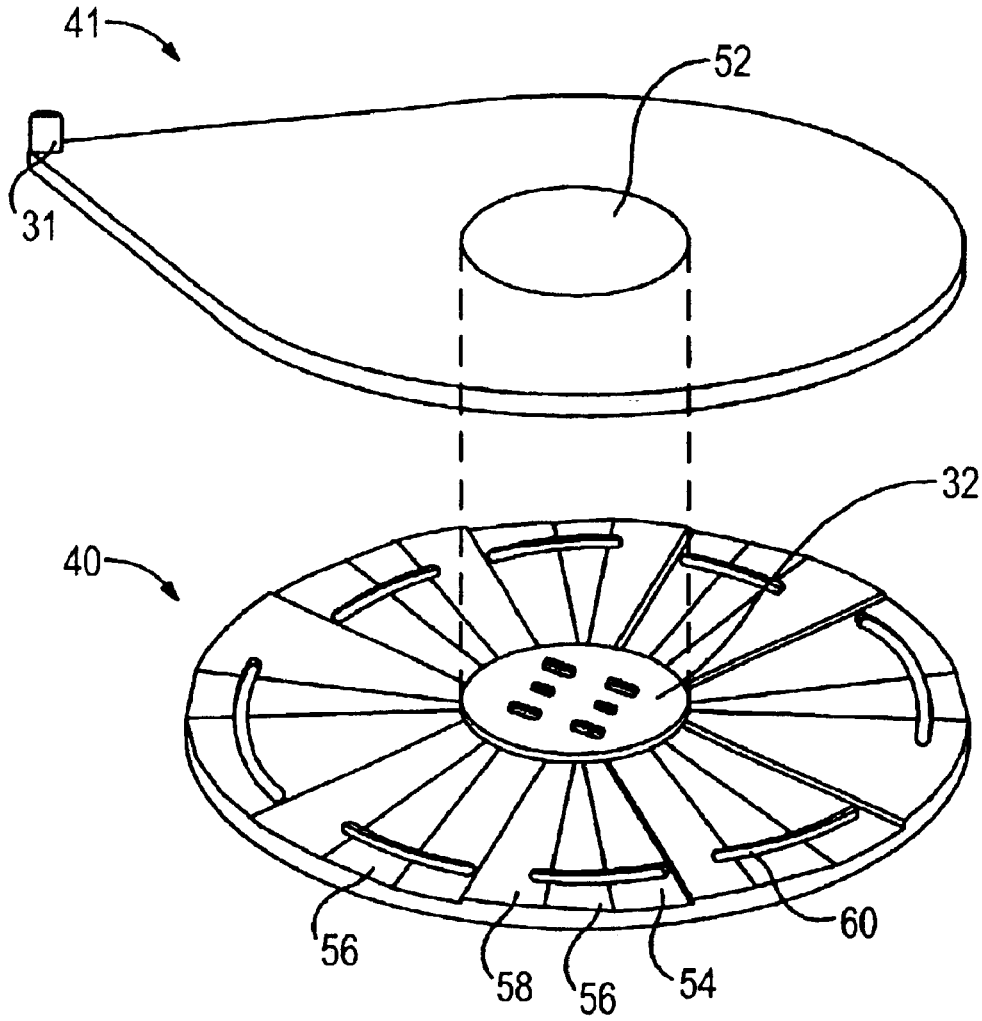
FIG. 3 is a perspective view of the clutch disk and the spacing disk of FIG. 2.
Figure 5:
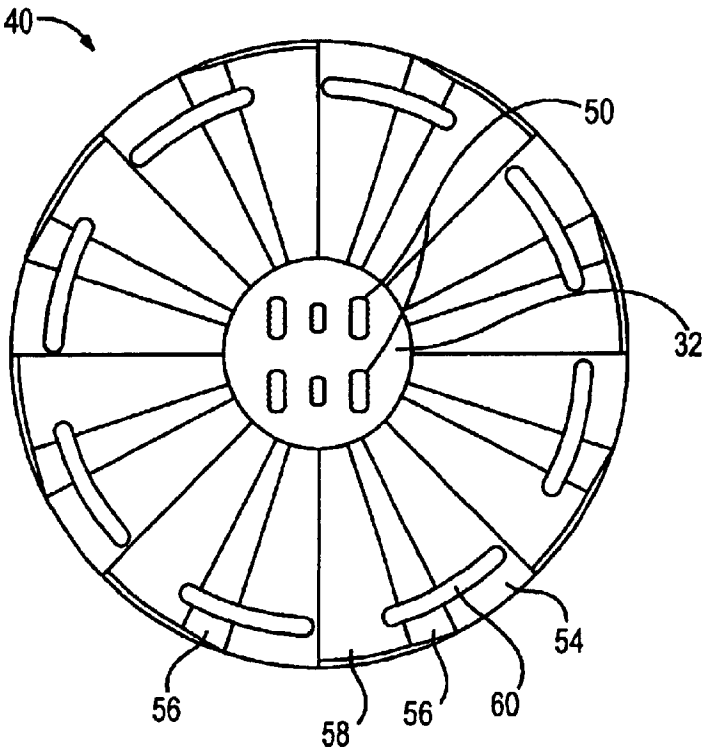
FIG. 5 is a top view of the spacing disk of FIG. 3.

Referring now to FIGS. 2, 3, 4 and 5, the illustrated clutch device 30 includes a lower plate 40 and an upper plate 41. As best seen in FIG. 3, the spacing disk 32 may be integrated into the lower plate 40. The spacing disk includes six elongated openings 50, where the arrangement of the openings is selected to allow the clutch device to be used with any of the conventional hole patterns within commercially available boards. For example, the clutch device may be used with either the three-hole pattern on the board of FIG. 2 or with the four-hole pattern that is also commonly used with snowboards.

The upper plate 41 includes the handle 31 and a central opening 52 having a diameter slightly greater than the diameter of the spacing disk 32 of the lower plate 40. Thus, the spacing disk will pass freely through the central opening 52 in the upper plate, so that the upper plate can be rotated relative to the lower plate.

The upper surface of the lower plate 40 is formed of a repeating series of a lower flat region 54, a ramped region 56, and an upper flat region 58. A slot 60 extends through each series of the three regions. The slot begins at the start of a lower flat region 54, extends completely through the ramped region 56, and partially passes through the upper flat region 58. The series of three regions is not critical to the invention, since other arrangements in which thickness is varied can be substituted.

Figure 4:
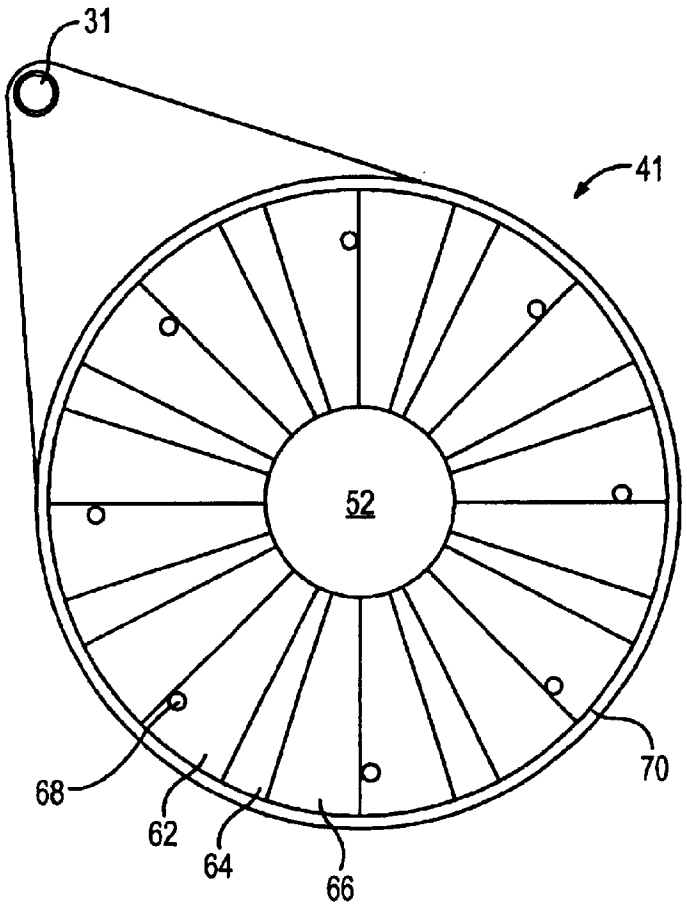
FIG. 4 is a bottom view of the clutch disk of FIG. 3.

FIG. 4 is a view of the bottom surface of the upper plate 41. In the same manner as the lower plate 40, the surface of the upper plate is a repeating series of a lowermost flat region 62 ("lowermost" when the plate is viewed in the orientation of FIGS. 2 and 3), a ramped region 64, and an uppermost flat region 66. A downwardly extending projection 68 is positioned at the beginning of each lowermost flat region 62. The regions 62, 64 and 66 are not visible in the perspective view of FIG. 3, since the upper plate includes a circumferential lip 70 that retards the entrance of snow and ice into the area between the two plates 40 and 41.

In operation, the lower plate 40 is locked in position by the passage of the screws 10 through the openings 50 in the spacing disk 32. However, the upper plate 41 is able to rotate relative to the lower plate. A user may grip the handle 31 and move the upper plate between a locked position and a release position. In the embodiment illustrated in FIGS. 2 and 3, the release position is one in which the upper plate 41 is at its extreme counterclockwise location, thereby aligning the lowermost flat regions 62 of the upper plate with the lower flat regions 54 of the lower plate. Then, as the upper plate is rotated in a clockwise direction, the projections 68 of FIG. 4 will ride within the slots 60 of FIG. 5 and the two sets of ramped regions 56 and 64 will cause an increase in the thickness of the clutch device 30. The thickness will continue to increase until the flat regions 62 of the upper plate 41 rest on the flat regions 58 of the lower plate.

In the minimum-thickness position of the clutch device 30, the binding 21 is able to be lowered sufficiently to release the press-fit engagement with the binding disk 20. As a result, the binding 21 can be rotated while all of the components remain attached to the board 23. Then, when the upper plate 41 of the clutch device 30 is rotated to its extreme clockwise position, the clutch device will have its maximum thickness, thereby pressing the binding into a tight engagement with the binding disk 20.

It should be noted that the present invention may be used with existing mounting holes 24 in the board 23 and may be used with the commercially available bindings 21 and binding disks 20. Other than the two plates 40 and 41, no additional screws or components are required. This results in several significant advantages, including (1) simplicity of design and manufacturing, (2) simplicity in parts and functions, providing reliable operation in snow and ice conditions, (3) a manageable increase in thickness, which results in the binding 21 being mounted very nearly directly to the board 23, and (4) any difficulties in operation of the invention will not result in the binding disconnecting from the board. On the other hand, the clutch device may be integrated with a binding, so that the assembly of a binding and the device is purchased as a unit.

What is claimed is:

1. A mounting assembly for use with a board comprising:

a binding configured for attachment to a person's foot;

a securing mechanism cooperative with said binding for securing said binding to said board at a selectable angle which is fixed when said binding is engaged with said securing mechanism; and an adjustment mechanism having a thickness which is variable so as to define a lock condition and a release condition, said binding being trapped between said securing mechanism and said adjustment mechanism when said adjustment mechanism is in said lock condition, said adjustment mechanism being positioned such that said binding is disengaged from said securing mechanism when said adjustment mechanism is set at a first thickness that establishes said release condition, said binding and said securing mechanism being engaged when said adjustment mechanism is set at a second thickness that establishes said lock condition, said adjustment mechanism being configured to enable access to switching between said lock and release conditions while said binding remains attached to said person's foot.

2. The mounting assembly of claim 1 wherein said adjustment mechanism includes a first member and a second member, said first and second members being cooperative to switch said adjustment mechanism between said lock and release conditions in response to relative movement of said first and second members.

3. The mounting assembly of claim 2 wherein said first and second members are plates located between said binding and said board, said adjustment mechanism inducing separation between said binding and said securing mechanism with variations in said thickness, said binding being free to rotate and to move perpendicular to said plates when said adjustment mechanism is in said release condition.

4. The mounting assembly of claim 2 wherein said first member includes ramped regions along a surface that is in contact with said second member, said ramped regions at least partially determining variations in said thickness.

5. The mounting assembly of claim 4 wherein said second member includes second ramped regions along a second surface that rides along said surface of said first member with relative rotation therebetween, said first and second members including first flat regions that are in contact when said adjustment mechanism is in said lock condition and including second flat regions that are in contact when said adjustment mechanism is in said release condition.

6. The mounting assembly of claim 5 wherein said first and second members are disk-shaped and said second member includes a handle.

7. The mounting assembly of claim 4 wherein said second member includes projections and said first member includes slots along said surface, said projections and slots being aligned to enable said projections to follow said slots as said relative movement occurs.

8. The mounting assembly of claim 1 wherein said binding is a boot mounting that is specific to attachment to one of a snowboard and a wakeboard.

9. The mounting assembly of claim 1 wherein said adjustment mechanism is clutch based.

10. A mounting assembly for use with a board comprising:

a binding configured for attachment to a person's foot, said binding having an opening;

a securing mechanism configured to fit within said opening of said binding, said securing mechanism being cooperative with said binding for securing said binding to said board at a selectable fixed angle when said binding is engaged with said securing mechanism; and a clutching mechanism located between said binding and said board, said clutching mechanism having a locked position in which said binding is engaged with said securing mechanism and having a release position in which said binding is free to rotate relative to said securing mechanism while remaining attached to said board, said clutching mechanism including first and second members having ramped regions aligned to enable variations in the distance of said binding from said board so as to switch from said locked position to said release position, said clutching mechanism being configured to enable switching between said locked and release positions while said binding remains attached to said person's foot.

11. The mounting assembly of claim 10 wherein said clutching mechanism is configured to selectively lift said binding into a press-fit engagement with said securing mechanism when said clutching mechanism is moved from said release position to said locked position.

12. The mounting assembly of claim 10 wherein said binding is specific for attachment to one of a snowboard and a wakeboard.

13. The mounting assembly of claim 10 wherein at least one component of said clutching mechanism is integrally formed with said binding.

* * * * *